US005131602A

United States Patent [19]

Linick

[11] Patent Number: 5,131,602

[45] Date of Patent: Jul. 21, 1992

[54] APPARATUS AND METHOD FOR REMOTE GUIDANCE OF CANNON-LAUNCHED PROJECTILES

[76] Inventor: James M. Linick, P.O. Box 1512, La Quinta, Calif. 92253

[21] Appl. No.: 537,296

[22] Filed: Jun. 13, 1990

[51] Int. Cl.[5] ..... F41G 7/28

[52] U.S. Cl. ..... 244/3.14; 342/62; 244/3.19

[58] Field of Search ..... 244/3.14, 3.19, 3.11, 244/3.13; 342/62

[56] References Cited

U.S. PATENT DOCUMENTS

| | | | |
|---|---|---|---|
| 3,698,811 | 10/1972 | Weil | 244/3.14 X |
| 3,832,711 | 8/1974 | Grant et al. | 244/3.19 X |
| 3,856,237 | 12/1974 | Torian et al. | 244/3.11 |
| 3,995,792 | 12/1976 | Otto et al. | 244/3.14 |
| 4,010,467 | 3/1977 | Slivka | 244/3.16 X |
| 4,097,007 | 6/1978 | Fagan et al. | 244/3.11 |
| 4,100,545 | 7/1978 | Tabourier | 342/62 |
| 4,220,296 | 9/1980 | Hesse | 244/3.14 |
| 4,350,983 | 9/1982 | Blaha et al. | 244/3.19 X |
| 4,407,464 | 10/1983 | Linick | 244/3.13 |
| 4,453,087 | 6/1984 | Linick | 250/334 |
| 4,769,748 | 7/1987 | Bloomquist | 244/3.19 |
| 4,886,330 | 12/1989 | Linick | 350/6.5 |
| 4,925,129 | 5/1990 | Salkeld et al. | 244/3.11 |
| 4,926,183 | 5/1990 | Fourdan | 342/67 |
| 4,971,266 | 11/1990 | Mehltretter et al. | 244/3.19 |
| 4,997,144 | 3/1991 | Wolff et al. | 244/3.14 |

OTHER PUBLICATIONS

Modern Land Combat: Christopher F. Foss and David Miller, pp. 39–45.

*Primary Examiner*—John B. Sotomayor

*Attorney, Agent, or Firm*—Howrey & Simon

[57] ABSTRACT

The present invention relates to ground-based electromechanical search and communications apparatus used in conjunction with airborne communications apparatus The ground-based apparatus maintains contact with and determines the precise location of the airborne apparatus within a defined space. Additionally, the airborne apparatus may receive data from a satellite system as to its inertial coordinates within object space. The apparatus of the invention includes a ground-based electronically and/or mechanically controlled antenna, an integral transmitter and computer and an airborne transceiver with an integral antenna and computer. The airborne transceiver transmits to, and on occasion receives, a discrete commands from the ground-based apparatus. The ground-based apparatus via transmissions received from the airborne apparatus, will be able to determine the precise location in object space of the airborne apparatus and extrapolate its future location. Additionally, the ground-based apparatus can issue commands to the airborne apparatus to alter its path of flight. The alterations of trajectory correction will be achieved via an onboard airborne trajectory correction module.

24 Claims, 4 Drawing Sheets

APPARATUS AND METHOD FOR REMOTE GUIDANCE OF CANNON-LAUNCHED PROJECTILES

BACKGROUND OF THE INVENTION

1. Field of the Invention

This invention relates to cannon-launched projectiles or similar airborne vehicles. More particularly, this invention relates to apparatus and methods for searching for, tracking and remotely guiding cannon-launched projectiles, rockets and similar airborne vehicles to impact a selected target.

2. Description of the Prior Art

It was well-recognized in the prior art that a cannon-launched projectiles followed a ballistic trajectory which could be fairly well calculated. This knowledge enabled a gunner to fire projectiles to impact preselected target areas with reasonable consistency.

It also was known in the prior art to use land based apparatus to search the space in which the cannon-launched projectiles or rockets were expected to appear (known as object space) and thereafter locate and track such projectiles while they were in flight. The purpose of such prior art systems was to aid artillery and rocket launch batteries in obtaining greater accuracy by noting deviations from the expected trajectories of tracked projectiles, resulting from wind, weather or other reasons. The artillery or launch battery, when given the precise flight details of an actual projectile, could then adjust its aim in subsequent salvos.

Such prior art systems utilized active radar, usually in the frequency range of 12.5 to 18 Gigahertzs, to search object space. The reflected signal from the in-flight projectile was detected by the radar's receiving antenna. Then, a polar coordinate procedure could be used to track the in-flight projectile's path.

The search operation of such prior art systems was usually conducted by scanning the radar antenna mechanically in either a conical pattern or a raster pattern. The mechanical scanning mechanisms would be servo-controlled very precisely so that correct antenna positions could be achieved and/or noted.

The radar continuously emitted a beam of energy at power levels sufficient to produce a perceivable reflection from the flying projectile. Such power levels varied according to range, weather and the target's radar cross-section. Once a target of interest had been located, the search pattern would cease and the mechanized radar would then enter into a track pattern.

In order to maintain its track of a projectile, the radar had to continuously emit a signal commonly referred to as a beam. The track data, once acquired, was fed into the existing system's computer for further processing and relay to the user, such as the battery command center.

There have been many difficulties with these prior art apparatus. Mechanical systems of the proper sensitivity were so fragile that they proved unsuitable for field use and included many inherent errors which were difficult to detect. Additionally, reflections could vary greatly from one projectile to another because of, e.g., back scatter from rain, other scintillations, tilt of the projectile with respect to the beam, multipath reflections and the like.

Such prior art systems were also limited by their inability to search for and then track many projectiles at the same time because of mechanical limitations and the similarity of the reflected signatures from various projectiles. Mechanical systems, in order to have an acceptable degree of reliability, had to be made a size and weight which tended to increase manufacturing and selling costs prohibitively. Additionally, prior art tracking systems were subject to inaccuracies caused by round-to-round physical variations and time variant meteorological phenomena.

The present applicant has attempted to address some of these problems by disclosing improved imaging methods for the remote tracking systems. These systems involve fast framing thermal imaging systems comprising mechanical scanning devices for converting radiation in the far infrared spectral region to visible radiation in real time and at an information rate comparable to that of standard television. Such systems are commonly referred to as FLIR systems, the acronym for Forward Looking Infrared, and enable trackers in the field to effectively track projectiles when visually obscured by dust, darkness, or other environmental conditions.

These systems are disclosed in:

U.S. Pat. No. 4,407,464
U.S. Pat. No. 4,453,087
U.S. Pat. No. 4,886,330 all issued to the present applicant, James Linick.

Obviously, a major disadvantage of the cannon-launched projectile is the inability to control its trajectory after launch. One proposed control method would have incorporated a special signal within a radar carrier frequency which would have provided the projectile with guidance in the form of a midcourse correction. To date, such concepts have not become operational.

Another method, disclosed in U.S. Pat. No. 4,679,748 issued to Blomquist and Linick, discloses a cannon-launched projectile scanning and guidance system completely self-contained within the projectile itself. This system suffers from the inability of trackers at the artillery or launch battery to initiate control over the trajectory of the shell once flight has commenced.

Therefore, it is an object of the present invention to provide an apparatus and method which overcome the afore-mentioned inadequacies of the prior art devices by providing the improvement of searching for the projectile and then tracking and assisting in the remote guidance of weapons projectiles such as cannon and mortar launched projectiles, rockets and the like.

Another object of this invention is to provide a means to search the space in which the tracker expects the projectile to appear or object space by electronically intensive means rather than mechanically intensive means, thereby adding reliability, operation speed, lower physical weight and lower manufacturing costs.

Another object of this invention is to allow the ground-based apparatus to be substantially passive rather than continually active, thereby far more effectively maintaining the secrecy of the ground-based apparatus' location and, additionally, the battery cf artillery or rockets or the like to which it provides data.

Another object of this invention is to provide means to search for, locate and track multiple projectiles or rockets or the like simultaneously, thereby adding to the versatility of the system and eliminating the need for many systems when one will be effective.

Another object of this invention is to permit more readily and discreetly, and in a more usable form, the transmission of guidance commands to flying projectiles or rockets or the like.

Another object of this invention is to permit clear communication between the ground-based apparatus and the airborne apparatus at extended and pre-planned ranges.

Another object of the invention is to provide a means of round-to-round inflight trajectory correction.

The foregoing has outlined some of the more pertinent objects of the invention. These objects should be construed to be merely illustrative of some of the more prominent features and applications of the invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments below.

SUMMARY OF THE INVENTION

The present invention includes two (2) separate and distinct apparatus, one airborne and the other ground-based, forming a SYSTEM. These apparatus communicate with each other, record and process the data of this communication, and then provide a means by which data may be made available to the use of the invention, i.e.. THE SYSTEM USER.

More particularly, the invention comprises, first, ground-based search, communications and signal processing apparatus. This apparatus can consist of a variety of known sub-assemblies and components. However, for the specific embodiment to be hereinafter described, this apparatus would utilize an electronically-scanned phased array antenna or, optionally, an electronically-switched horn feed antenna. When either antenna is used, the azimuthal search area will enable compensation for azimuthal firing errors from the battery, with or without mechanical azimuthal movement of the antenna.

Additionally, the ground-based apparatus will be equipped with a radio transmitter which will transmit to the airborne apparatus compatible pulsed or continous wave signals. The transmission is made from time to time, and only as necessary to establish range and/or to give a midcourse guidance command. A satellite system such as the Ground Positioning System (GPS) could also provide a midcourse correction data.

Finally, the ground-based apparatus will contain a computational hardware and software sub-systems. These computer sub-systems will have an input port to receive and process transmissions from the airborne radio transceiver apparatus.

The invention also comprises an airborne apparatus. This apparatus transmits and receives signals to and from the ground-based apparatus, periodically transmitting signals to the ground-based apparatus and receiving discrete frequency messages from the ground-based apparatus and/or a satellite system such as GPS. Such further additional messages can be then passed to the flying vehicle navigation and guidance trajectory correction module to affect midcourse flight corrections.

Therefore, this invention comprises a ground-based apparatus and an airborne apparatus and the possible utilization of a satellite system, all interacting and communicating with one another as set forth within this summary above and as will further be described in the following detailed description of the preferred exemplary embodiment.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENTS

Figure 1:
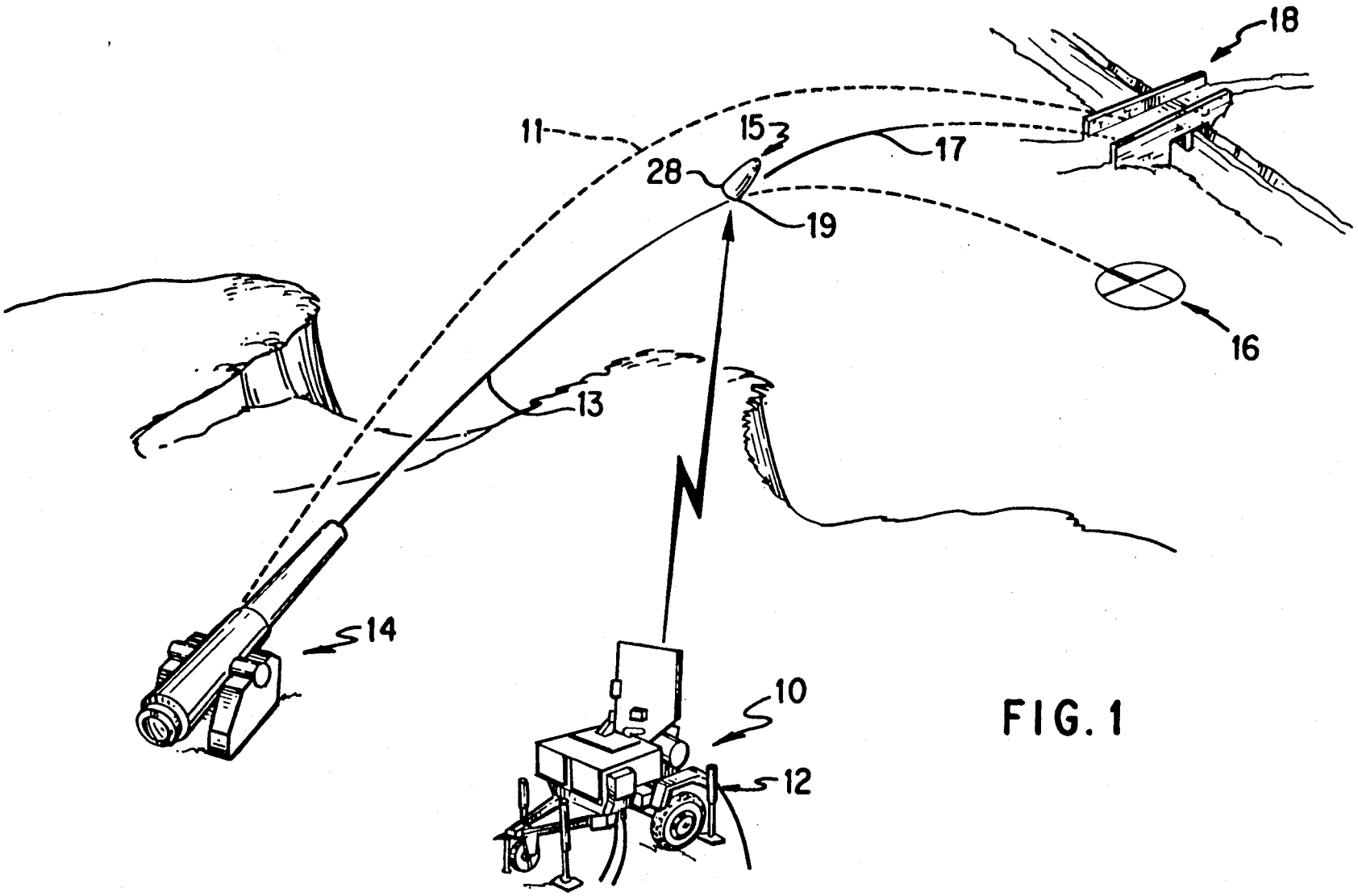
FIG. 1 is a diagrammatic view illustrating a typical trajectory correction of a projectile guided in accordance with a preferred embodiment of the present invention utilizing a ground-based tracking apparatus;.

Referring to FIG. 1, ground-based tracking apparatus 10 is mounted on a carriage means 12 located near cannon battery 14. Tracking apparatus 10 comprises a variety of search, communications and signal processing apparatus. The operation of these apparatus are described below in detail. However, the details of their specific circuits are conventional and need not be presented here. FIG. 1 further illustrates the manner in which a mid-course correction can be applied by tracking apparatus 10 to projectile round 15 to alter its trajectory to hit a desired target 18. When fired, the projectile was intended to follow trajectory 11. However, because of errors induced by wind, etc., the projectile actually followed trajectory 13, which would terminate at incorrect impact point 16. The invention provides, at correction point 19, a mid-course alteration of the path of projectile 15 to new trajectory 17, resulting in the impact of the projectile on desired target 18. The particular methods by which this correction is achieved are described below.

As shown in FIG. 1, ground-based tracking apparatus 10 and projectile 15 communicate with each other. At a given and predetermined time in its flight, airborne apparatus 28 on projectile 15 begins transmitting to ground-based apparatus 10. This transmission which may be pulsed or continuous wave enables ground-based apparatus 10 to derive the azimuthal and elevational positions of projectile 15 in object space. Ground-based apparatus 10 at discrete intervals interrogates airborne apparatus 28 with either a pulsed or continuous wave transmission. The response to this interrogation signal provides the slant range to projectile 15. From this information, projectile 15 can be tracked by ground-based apparatus 10.

Figure 2:
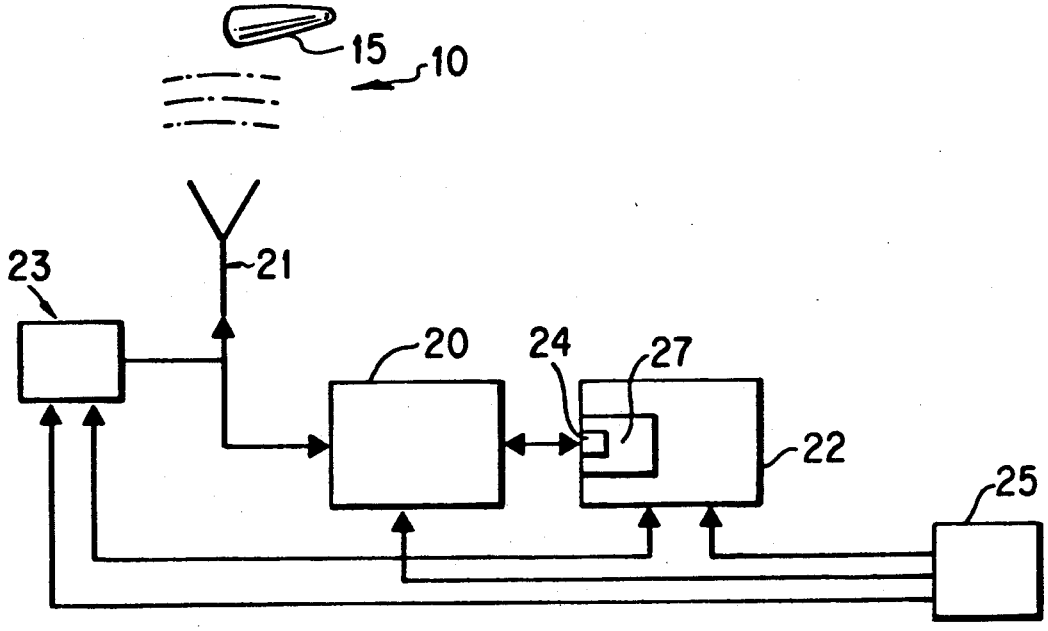
FIG. 2 is a block diagram of the ground-based tracking apparatus of the present invention.

In particular, as shown in FIG. 2, remote tracking apparatus 10 includes antenna 21 which is directionally oriented either mechanically or electronically via antenna electro-mechanical stabilization means 23. Antenna 21 communicates the received radio frequency (RF) tracking signals described above to transceiver 20, which detects, demodulates and converts the RF signal into data signals which are then sent to computational hardware and software means 22, via data input/output port 24. Computational hardware and software means 22 under SYSTEM USER control analyzes the input data to arrive at a trajectory correction signal, which is then outputted to the transceiver 20 via data input-/ouput port 24. Transceiver 20 converts the correction signal into an RF signal for broadcast to projectile round 15 via antenna 21. Computational hardware and software means 22 also controls electro-mechanical stabilization means 23 to alter the azimuth and elevation orientation of antenna 21, keeping antenna 21 continuously oriented toward toward projectile round 15. Alternatively, stabilization means 23 may be a conventional closed-loop servomechamism which directly orients the antenna 21 in azimuth and elevation and reports that orientation to computational means 22. Power supply 25 supplies power to antenna stabilization means 23, transceiver 20 and hardware and software means 22. Computational hardware and software means 22 includes a interface communication means (not shown) which enables various data maintained in the computational hardware and software means 22 to be displayed or otherwise communicated to the SYSTEM USER.

Antenna 21 can be of a conventional design, requiring mechanical orientation alterations from stabilization means 23, or, for the specific embodiment to be hereinafter set forth, preferably utilizing electronically-scanned phased array elements or, optionally, electronically-switched horn feed elements. In any case, the azimuthal search area will enable compensation for azimuthal firing errors from cannon battery 14, with or without mechanical azimuthal movement.

For example, the azimuthal search angle could be 68 milliradians, thereby providing a coverage of 1360 meters at a range of 20,000 meters. The resolution provided by phased array antenna elements (not shown) could be 1.0 milliradian. The total elevational search angle without mechanical movement could be one beam width. For a typical wave length and antenna diameter used in the SYSTEM, this elevational search angle could be on the order of 8.0 milliradians. Therefore, the observed static geometry in object space would have a depth of 160 meters (i.e., 8 milliradians$\times$20,000 meters$=$160 meters). Antenna 21 is designed to receive radio signals in the frequency range of signals being transmitted by the airborne apparatus 28. Antenna 21 could move in a continuous and unidirectional elevational motion to maintain track, or it could be set at a fixed elevational position and wait for the flying projectile round 15, rocket or the like to enter its area of search. When a phased array antenna is used with the invention, the computational hardware and software means 22 may incorporate the necessary delay elements (not shown) to operate the antenna in the beam splitting mode of operation. This increases the antenna's versatility in performing track procedures.

Figure 3:
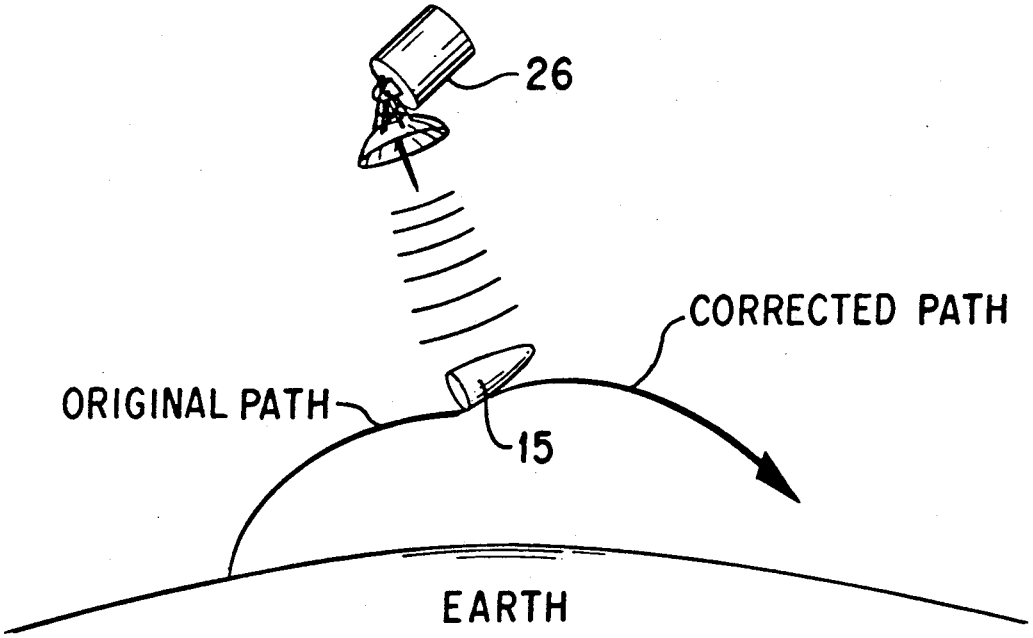
FIG. 3 is a diagrammatic view illustrating typical trajectory correction of a projectile guided in accordance with another embodiment of the present invention, utilizing satellite tracking apparatus.

Transceiver 20 transmits to the airborne apparatus compatible signals, from time to time and only as necessary to establish range and/or to give a midcourse guidance command. This transceiver 20 is a radio transmitter, not a radar. In the present invention, a reflected signal is neither required nor expected, nor could or would be utilized by this invention. A satellite system 26 containing the components of ground-based tracker 10, such as GPS, could also provide midcourse correction data, as shown in FIG. 3. Computational hardware and software means 22 contains computer tracking sub-system 27, which is connected to input port 24 to receive and process transmissions from the airborne radio transceiver apparatus 28. The tracking processing will include, but is not limited to: (i) X, azimuthal position and Y, elevation position; (ii) Z, slant range; (iii) extrapolation as to point of impact; and (iv) midcourse correction command.

Figure 4:
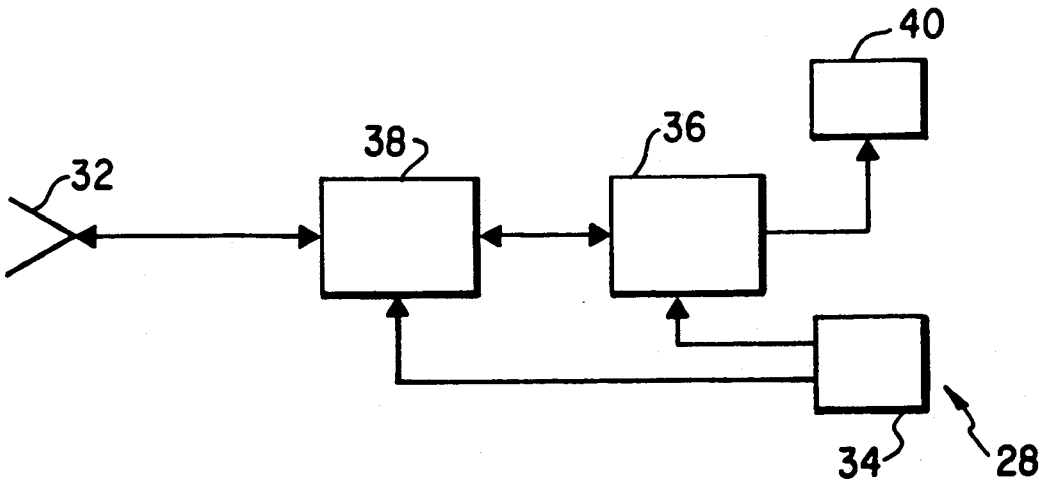
FIG. 4 is a block diagram of the airborne apparatus of the present invention.
Figure 6:
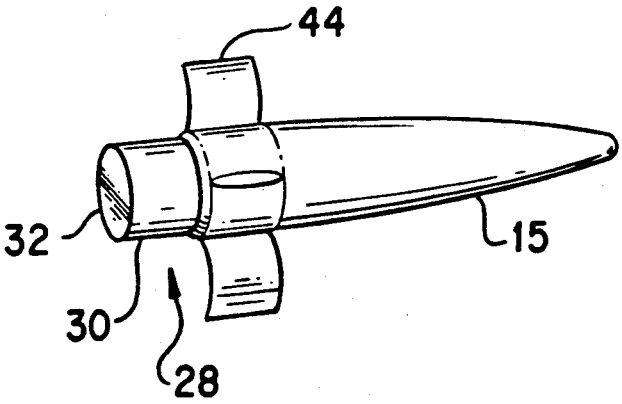
FIG. 6 is a perspective view of a projectile round containing another embodiment of the steering means of the present invention which includes fins.
Figure 5:
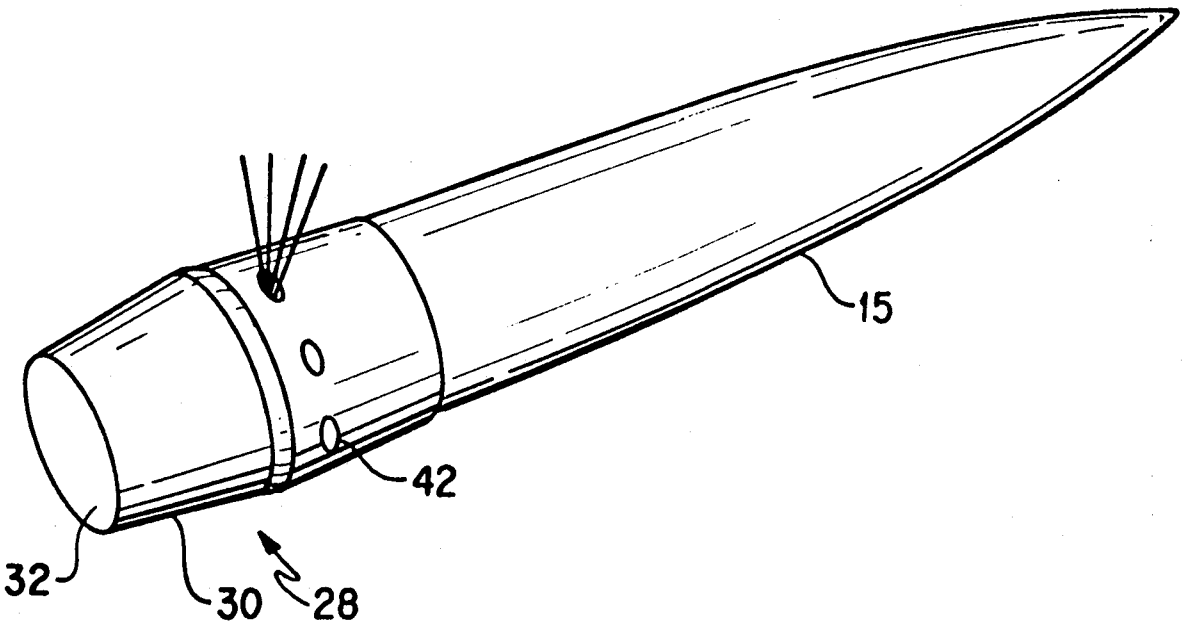
FIG. 5 is a perspective view of a projectile round containing a preferred embodiment of the steering means of the present invention which includes thrusters.

Turning to FIG. 3, airborne tracking apparatus 28 is contained in guided projectile round 15. Preferably airborne apparatus 28 would consist of a cylinder 30 (shown in FIG. 5) topped by a cone 32 (also shown in FIG. 5) whereby the exposed cone 30 acts as an omnidirectional antenna. The cylinder 30 would be internal to the projectile round 15 but integral with cone 32. As shown in FIG. 4, airborne tracking apparatus 28 also contains a power supply means 34, computational hardware means 36, transceiver means 38, trajectory correction module and steering means 40 and a mechanical interface (not shown) to attach it to the projectile round 15. Again, the specific circuits used in these elements are conventional and need not be described in detail. The cylinder-cone assembly can also be configured to be positioned in the proximity fuse location of various artillery and motor projectiles and other launched projectiles such as rockets. Signals from either ground-based tracking apparatus 10 or satellite system 26 are detected by antenna cone 32 and transceiver means 38 to be input to computational hardware means 36. Grounded-based apparatus 10 can provide the inertial coordinates of the target 18 if airborne tracking apparatus 28 needs that information. Computational hardware means 36 would then output a control signal to flying vehicle navigation and guidance trajectory correction module and steering means 40 to complete a midcourse correction of the projectile's trajectory. The trajectory correction module and steering means 40 preferably includes a plurality of small thrusters 42 radially placed around the circumference of the projectile 15 (shown in FIG. 5) or alternatively, motors (not shown) to control the position of radially placed fins 44, as shown in FIG. 6.

Airborne apparatus 28, at a given and predetermined time, begins transmitting to ground-based apparatus 10 preferrably in a pulsing mode at a very high repetition rate using a carrier frequency in the Gigahertzs range. This continuously-pulsing transmission enables ground-based apparatus 10 to derive the azimuthal (X) and elevational (Y) positions of airborne apparatus 28 in object space via, in the preferred embodiment, its phased array antenna 21. Additionally, ground-based apparatus 10, from time to time, interrogates airborne apparatus 28 with a discrete, different frequency pulse. The round trip answer back pulse from the airborne apparatus 28 to the ground-based apparatus 10 provides the precise slant range (Z). The time between the transmission of the interrogation pulse and the answer pulse is determined and the slant range is determined by conventional backranging techniques. Additionally, airborne apparatus 28 is able to receive additional discrete frequency messages from either ground-based apparatus 10 and/or satellite system 26. Such further additional messages are then handed off to the trajectory correction module and steering means 40 to affect midcourse flight corrections. Using either different frequencies and/or standard multiplexing techniques, ground-based appartus 10 can communicate with and control several airborne apparatus 28.

A typical operating scenario for the present invention is in the field of military fire control, such as for a battery of artillery or rockets. The operation of the system would occur as follows:

The ground-based apparatus 10 comprising the antenna 21 and its sub-systems would be located near battery 14. This ground-based apparatus 10 would communicate with the battery 14 and hence, the SYSTEM USER (not shown), via a radio link and/or a wire link (not shown).

Battery 14 would fire one or more projectiles 15 within a pattern broadly described by azimuthal and elevational (X,Y) vectors within object space, where each such projectile 15 would be equipped with an airborne apparatus 26 as previously described.

Immediately upon the firing of each projectile round 15, its (X,Y) azimuthal and elevational vectors would be communicated to the electro-mechanical stabilization antenna means 23 via the radio and/or wire link.

At a given predetermined point during the trajectory of each such projectile round 15, the airborne apparatus 28 would become activated.

Based on the firing data, the electro-mechanical stabilization means 23 would point antenna 21 so that antenna 21 will receive transmissions from airborne apparatus 28 at a point shortly after its activation.

The antenna 21 via its electronic and computational means 22 will determine a more precise (X,Y) azimuthal and elevational position of the airborne apparatus 28. Further, this position will be continually updated at the pulse rate of the airborne apparatus 28 as previously described, i.e., in the Gigahertz range.

From time to time during the trajectory of the projectile round 15, the ground-based antenna transceiver 20 will, on a separate and discrete frequency, interrogate the airborne apparatus 28. The airborne apparatus 28 will respond to such interrogation(s) with another separate and discrete pulse. The ground-based computer sub-system 27 will measure the round trip time of the interrogation pulse and answer back pulse and thus, precisely determine the slant range (Z) of the airborne apparatus 28, from the ground-based apparatus 10.

The ground-based computer sub-system 27 will store such data indicating the (X,Y,Z) azimuth, elevation and range position of the airborne apparatus 28 with respect to the ground-based apparatus 10. Additionally, this stored data will be continuously updated and refreshed by subsequent and similar data. Then, on a continuously updated basis, the computer sub-system 27 will extrapolate, from the aforesaid stored data, the future trajectory of the projectile round 15 to its point of impact.

The projectile round 15 previously described may be equipped with a steering means such as thrusters 42, deployable and adjustable fins 44, and/or various other well-known devices like a squib and/or devices that induce drag (not shown). The ground-based apparatus will be continually notifying the SYSTEM USER of the trajectory of projectile round 15. Upon such notification, and if the projectile round(s) 15 are equipped with a steering means, then the SYSTEM USER may command antenna transceiver means 20 to issue yet another series of discrete and separate frequency pulses. These pulses would, via airborne apparatus 28, be passed to the trajectory correction module and steering means 40 of projectile round 15. Thus, a mid course correction could be affected upon the flight and trajectory of each of any projectile round(s) 15 being so tracked.

Airborne projectile round 15 may also receive data from a satellite system 26 as to its instantaneous position in object space vis-a-vis the target.

Therefore, the specific embodiment of this invention which has been described as a SYSTEM will find ready use in a military artillery battery (or rocket battery) as an effective means to register the (X,Y,Z) azimuth, elevation and range coordinates of such projectile round(s) and further to offer a means to transmit trajectory correction commands from the SYSTEM user to any given projectile round as above described.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention. It is, for instance, evident that the present invention can and will be, with some minor modifications, easily adjusted and will find a useful implementation for any air ballistic ammunition delivery system.

I claim:

1. A system for remotely guiding a ballistic projectile, comprising:

a ground-based sub-system; and an airborne sub-system wherein said airborne sub-system includes (a) a first transmission means for communicating with said ground-based subsystem in the radio frequency portion of the electro-magnetic spectrum to provide to said ground-based system at a predetermined time or upon interrogation the azimuthal and elevational position of said airborne sub-system with respect to said ground-based subsystem and (b) a second transmission means for generating a signal to provide to said ground-based sub-system a slant range from said airborne sub-system to said ground sub-system at predetermined time or upon receipt of an interrogation signal from said ground-based sub-system, for use in providing in-flight mid-course corrections to the flight trajectory of said projectile.

2. A system as claimed in claim 1, wherein said ground-based sub-system includes:

means for searching for, tracking of, and communicating with said airborne sub-system, wherein said means further comprises:

antenna means; and means for orienting said antenna in azimuth and elevation of said antenna means.

3. A system as claimed in claim 2, wherein said means for orienting said antenna means is mechanical.

4. A system as claimed in claim 2 wherein said antenna means comprises a plurality of electronically-scanned phased-array elements.

5. A system as claimed in claim 2 wherein said antenna means comprises a plurality of electronically-switched horn feed elements.

6. A system as in claim 4 wherein said ground-based sub-system includes means for tracking in azimuth and elevation said airborne sub-system, wherein said tracking means further includes a beam-splitting means to operate the phased-array antenna elements in a beam-splitting mode.

7. A system as claimed in claim 4 wherein said ground-based sub-system includes a means for tracking in azimuth and elevation said airborne sub-system, wherein said tracking means includes means for control of said phased-array elements.

8. A system as claimed in claim 5, wherein said ground-based sub-system includes a means for tracking in azimuth and elevation said airborne sub-system, wherein said tracking means includes means of control of said horn-feed elements.

9. A system as claimed in claim 1, wherein said ground-based sub-system includes means for transmitting discrete radio frequency interrogation pulses to said airborne sub-system, and means for receiving discrete radio frequency answering pulses from said airborne sub-system.

10. A system as claimed in claim 9 wherein said ground-based sub-system includes:

backranging means to measure the time between transmission of one of said discrete interrogation radio frequency pulses to said airborne sub-system and the reception of discrete radio frequency answering pulses, establishing a slant range between said ground-based sub-system and said airborne sub-system and a complete polar coordinate data file between said ground-based sub-system and said airborne sub-system.

11. A system as claimed in claim 2, wherein said ground-based sub-system includes:

a means for orienting said antenna means in azimuth and elevation via closed-loop servo control at various velocities and amplitudes.

12. A system as claimed in claim 10, wherein said ground-based sub-system includes:

computational hardware and software means capable of controlling said searching, tracking and communicating means, wherein said searching, tracking and communication means includes an interrogation pulse transmitting means, an answering pulse receiving means, and an interface communicating means.

13. A system as claimed in claim 12, wherein said interface communication means enables communication of received data and other data and items of interest to the user of the system.

14. A system as claimed in claim 1 wherein said ground-based sub-system can communicate the inertial coordinates of a target to said airborne sub-system.

15. A system as claimed in claim 13, wherein said ground-based sub-system includes:

power supply means capable of powering said ground-based sub-system, including said searching, tracking and communicating means, said backranging means, and said interface communication means.

16. A system as claimed in claim 10, wherein said ground-based sub-system performs said searching, tracking and communicating means with respect to more than one of said airborne sub-systems, the only requirement being that the airborne sub-system transmitted radio signals be separated by frequency and/or time so as to keep each such airborne sub-system separate from any other such sub-system.

17. A system as claimed in claim 1, wherein said airborne sub-system is shaped to fit into a proximity fuse location of various artillery and mortar projectiles and launched vehicles such as rockets.

18. A system as claimed in claim 1, wherein said airborne sub-system includes a first transmit means to continuously transmit a discrete radio signal enabling said ground-based sub-system to search for and then subsequently track said airborne sub-system.

19. A system as claimed in claim 18, wherein said airborne sub-system includes:

receiving means; and a second transmit means to answer an interrogation signal from said ground-based sub-system with a discrete and precisely-timed radio frequency signal, wherein the round trip time between the interrogation signal and the answering signal will establish a slant range between said ground-based sub-system and said airborne sub-system.

20. A system as claimed in claim 19, wherein said airborne sub-system includes an antenna means to transmit and receive said radio frequency signals either in continuous wave form or pulse form.

21. A system as claimed in claim 19, wherein said airborne sub-system includes a computational hardware and software means to control its various internal sub-systems including said first and second transmit means and said receiving means.

22. A system as claimed in claim 21, wherein said airborne sub-system includes an internal power supply capable of providing electrical power for all the purposes of the sub-system.

23. A system as claimed in claim 1 wherein said airborne system includes a means to receive data from a satellite system as to its instantaneous inertial coordinates, wherein such data when compared to inertial coordinates of the target can be translated into a trajectory correction vectorial data.

24. A system as claimed in claim 23, wherein said airborne system includes a means to utilize the vectorial data and cause an inflight trajectory correction maneuver.

* * * * *